US007097000B2

(12) United States Patent
Teramoto et al.

(10) Patent No.: US 7,097,000 B2
(45) Date of Patent: Aug. 29, 2006

(54) ELEVATOR APPARATUS

(75) Inventors: Takashi Teramoto, Chiyoda (JP); Naoaki Noguchi, Chiyoda (JP); Atsushi Arakawa, Chiyoda (JP); Atsuya Fujino, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 404 days.

(21) Appl. No.: 10/616,966

(22) Filed: Jul. 11, 2003

(65) Prior Publication Data

US 2004/0007428 A1 Jan. 15, 2004

(30) Foreign Application Priority Data

Jul. 11, 2002 (JP) ..... 2002-202060
Jul. 17, 2002 (JP) ..... 2002-207672

(51) Int. Cl.
*B66B 9/00* (2006.01)

(52) U.S. Cl. ..... 187/249; 187/257

(58) Field of Classification Search ..... 187/249, 187/254, 258, 313, 401, 402, 414
See application file for complete search history.

(56) References Cited

U.S. PATENT DOCUMENTS 1,763,198 A * 6/1930 Sprague ..... 187/249
1,837,643 A * 12/1931 Anderson ..... 187/249
1,896,776 A * 2/1933 James ..... 187/249
1,911,834 A * 5/1933 Lindquist ..... 187/249
1,930,239 A * 10/1933 Hunt ..... 187/249
1,976,495 A * 10/1934 Halfvarson ..... 187/249
5,107,962 A * 4/1992 Ekholm ..... 187/249
5,375,682 A * 12/1994 Gopner ..... 187/411
5,584,364 A * 12/1996 Sakita ..... 187/249
5,651,426 A * 7/1997 Bittar et al. ..... 187/249
5,857,545 A * 1/1999 Barrett et al. ..... 187/249
6,354,404 B1 * 3/2002 Sansevero et al. ..... 187/249

FOREIGN PATENT DOCUMENTS

JP 02282177 A * 11/1990
JP 02295876 A * 12/1990
JP 03095087 A * 4/1991
JP 05201653 A * 8/1993
JP 2000-351537 12/2000
WO WO 9108161 A * 6/1991

* cited by examiner

*Primary Examiner*—Kathy Matecki
*Assistant Examiner*—Evan Langdon
(74) *Attorney, Agent, or Firm*—Crowell & Moring LLP

(57) ABSTRACT

An elevator apparatus comprises two (2) or more sets of elevators with one (1) piece of an elevating passage. Each of the elevators has an elevator car and a hoist, which is connected to the elevator car through a rope. Each the hoist has a sheave, a motor and a brake. The hoist of one of the elevators is projected above the elevator car of the other elevator. Also, open/close doors of the one elevator and those of the other elevator are disposed, so that they shift in front and behind. Door cases of the juxtaposing elevators are disposed to overlap with each other in front and behind.

9 Claims, 11 Drawing Sheets

ELEVATOR APPARATUS

BACKGROUND OF THE INVENTION

The present invention relates to an elevator apparatus, and it relates, in particular, to an elevator apparatus, wherein a plural number of elevators are installed within one (1) elevating passage, juxtaposing with each other.

Conventionally, an example is already known of an elevator apparatus, in which two (2) or more sets if elevators are installed juxtaposing with each other, such as, in Japanese Patent Laying-Open No. 2000-351537, for example. With such the elevator apparatus as described in this publication, for the purpose of improving space efficiency of a building, a building wall is provided between the doorways of the two (2) elevators, and elevator control units for each thereof are provided within that building wall.

With such the elevator apparatus as described in Japanese Patent Laying-Open No.2000-351537 mentioned above, for the purpose of reducing a space for installing the elevators, an attention is paid, in particular, on a space for installing the control units of the elevators which are provide juxtaposing with each other. However, with the elevators of high-lift or high-speed, it is desired to reduce, not only the space for installing the control units therein, but also to reduce the space for installing a hoist, which accordingly increases the volume thereof, but in this publication is not paid sufficient consideration on that aspect.

Also, when equipments other than the elevator cars are disposed conventionally, there is a possibility that the juxtaposing elevator cars interfere with each other, in particular, on the door pockets thereof. In the elevator apparatus described in the publication mentioned above, since there is ascertained an enough space for installing the juxtaposing elevators therein, so that each of the elevators operates independently, then no such the drawback will occurs on the doors of the cars. However, the space for installing the elevators must be wider for it.

On a while, when installing the hoists for the elevators, a thin-type hoist having a disk-like motor is mounted on a wall surface of the elevating passage, or a cylinder-like motor is installed at a top or a bottom of the elevating passage. For this reason, with the method of installing the hoists on the wall surface of the elevating passage, the elevating passage must be increased in the cross-section of an area thereof if the hoist is large in the volume thereof. While, with the method of installing the hoist on the bottom of the elevating passage, there is necessity of providing pulleys for hanging up the cars by means of a rope at the top of the elevating passage, as well as, suspending the rope from the hoist to the pulley at the top. As a result of this, if the lift is higher, the length of the rope to be suspended around is also longer, and therefore it brings bout a vibration of the car, which is caused due to plasticity of the rope. With the elevator of high-lift or high-speed, from the reason mentioned above, the hoists are mounted directly within a top portion of the elevating passage, or within a machine room which is provided separately from the elevating passage, however it is desired to make the machine room small.

BRIEF SUMMARY OF THE INVENTION

An object according to the present invention, which is achieved by paying attention on such the drawbacks of the conventional arts, mentioned above, is to ascertain an area occupied by the elevator cars, within an elevator apparatus in which a plural number of elevators are installed juxtaposing with each other. Other object according to the present invention is to reduce the area for installing the elevator cars therein. Further other object according to the present invention is to achieve a retrofitable elevator apparatus, in which two (2) sets of elevators can be installed within a space for one (1) set of elevator. Further other object according to the present invention is to achieve the elevator apparatus, with which a number of parts can be reduced down and thereby simplifying the installation work thereof. According to the present invention, an object thereof is to achieve at least one of those objects mentioned above.

According to the present invention, for accomplishing any one of the above objects, first of all, there is provided an elevator apparatus, comprising: a plural number of elevators, being disposed juxtaposing with each other, each of said elevator having, an elevator car, and a hoist, being connected to said elevator car through a rope, wherein the hoist of one of said elevators is protruded above the elevator car of the other elevator, or wherein a perpendicular projection of the hoist of one of said elevators has a portion overlapping on a perpendicular projection of the elevator car of the other elevator.

Also, according to the present invention, for achieving the object mentioned above, there is provided an elevator apparatus, providing a plural number of elevators juxtaposing with each other within an elevating passage, wherein positions of an open/close door portion of one of the elevators and an open/close door portion of the other of the elevators are set into a relationship of busing on positions in front and behind.

Further, according to the present invention, for achieving the object mentioned above, there is also provided an elevator apparatus, having a plural number of elevators provided juxtaposing with each other within an elevating passage, each elevator having an elevator car and a hoist, which is connected to the elevator car through a rope, wherein the hoist of one elevator projects above the elevator car of the other elevator, and comprising a hall side door guidance groove for allowing an open/close door of the one elevator to project to a side of the other elevator when said open/close door opens.

DETAILED DESCRIPTION OF THE INVENTION

Figure 1:
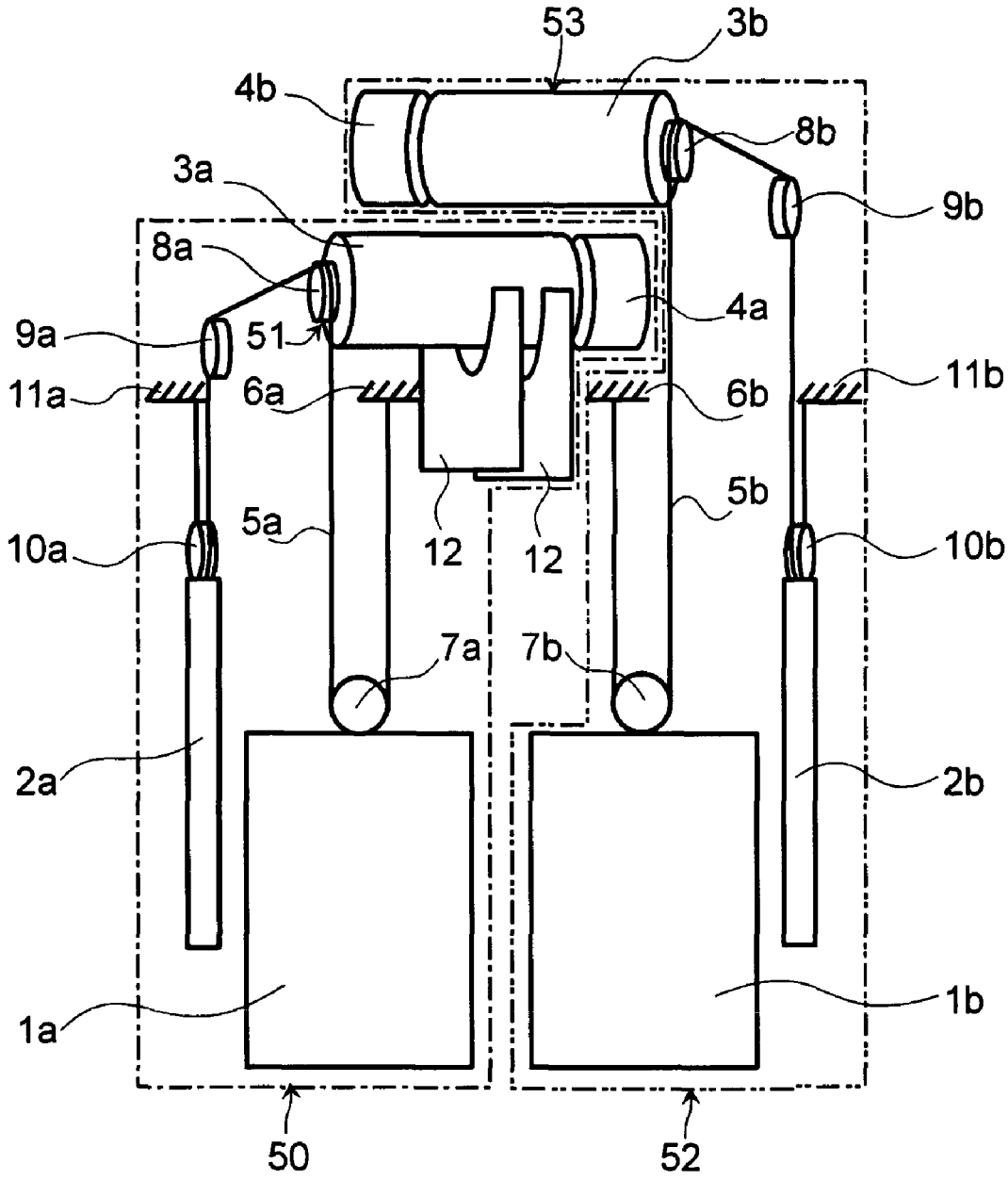
FIG. 1 is a block diagram of an elevator apparatus, according to one embodiment of the present invention.
Figure 2:
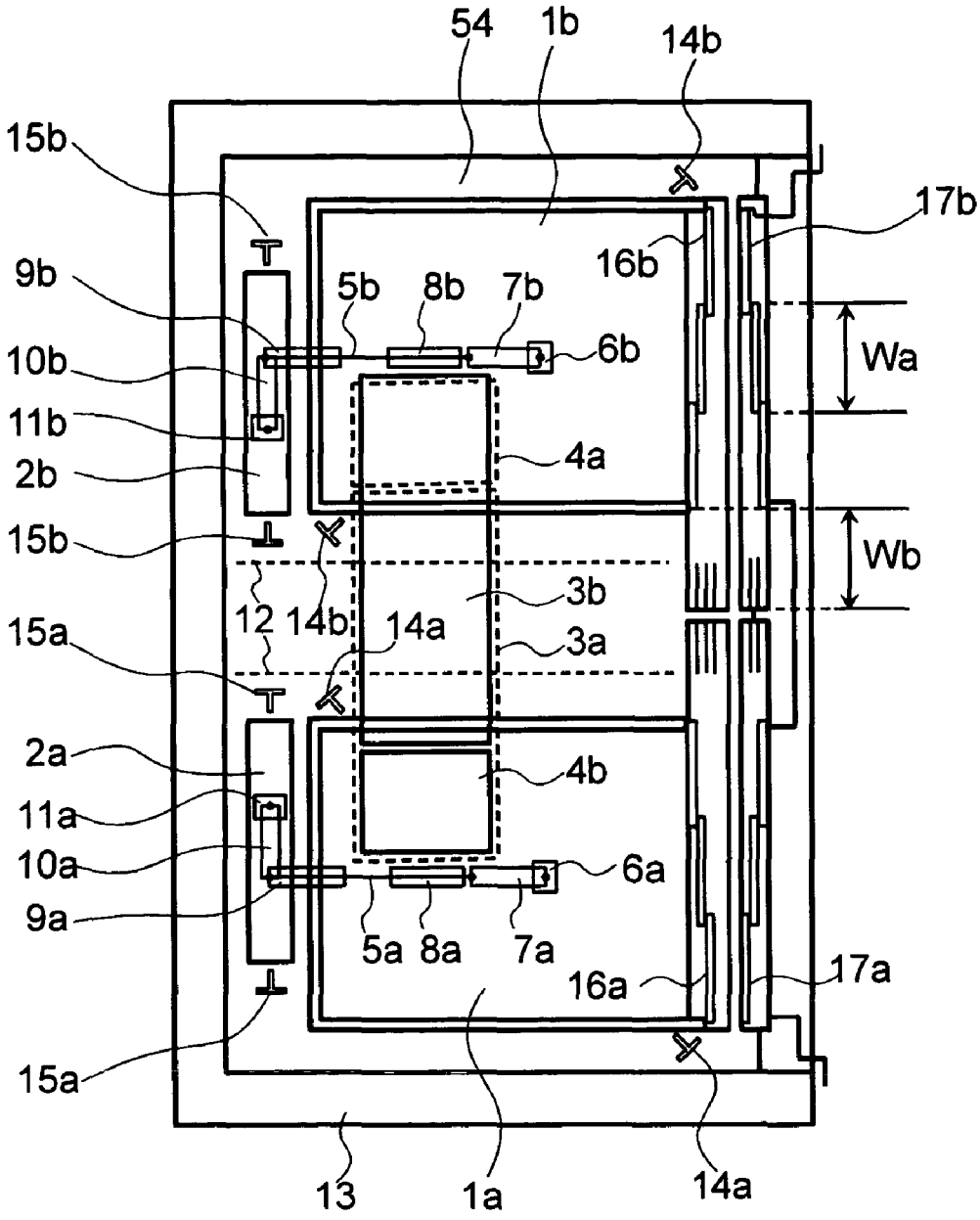
FIGS. 2 and 3 are an upper cross-section view and a side cross-section view of the elevator apparatus shown in FIG. 1.
Figure 3:
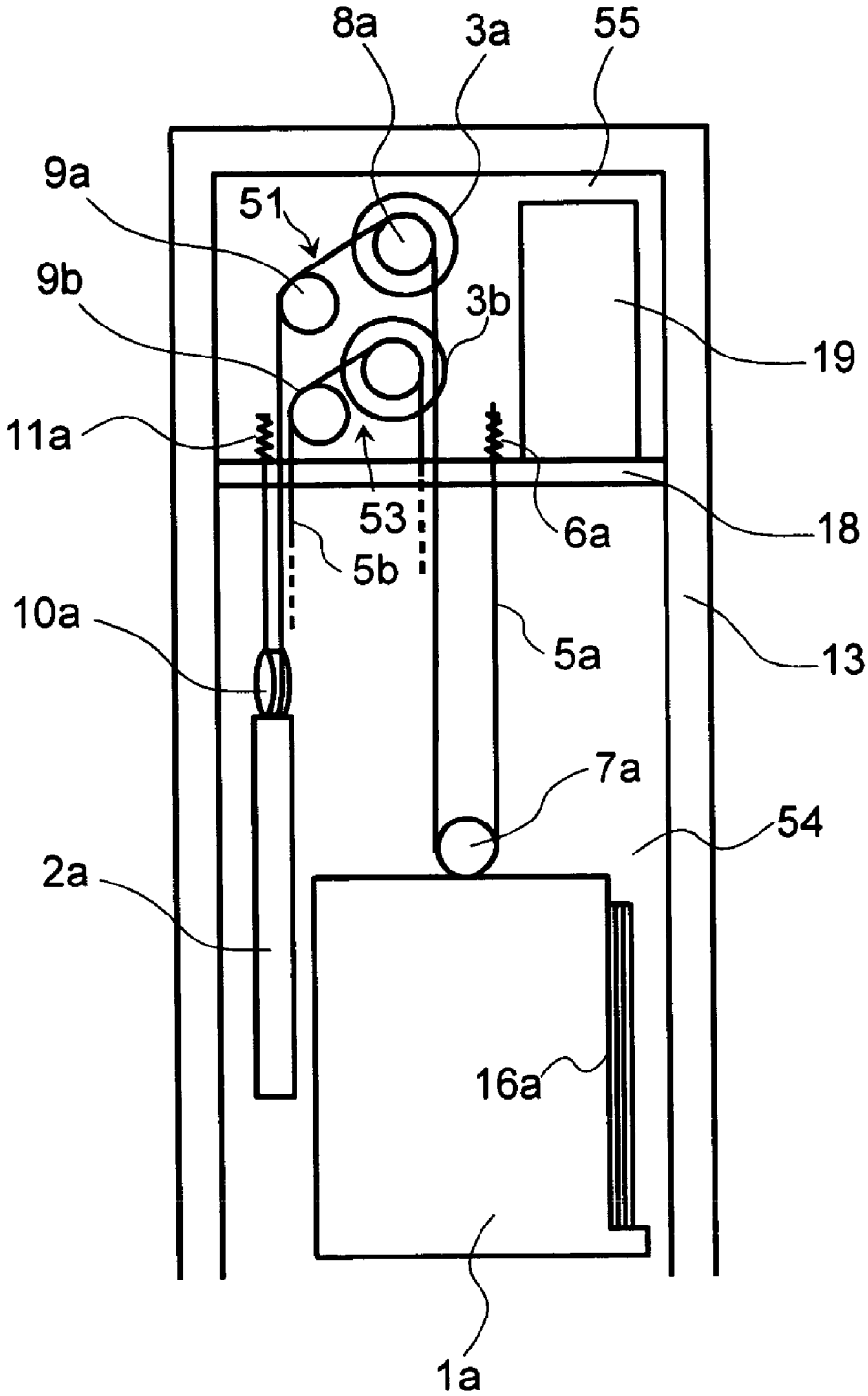

Hereinafter, several embodiments according to the present invention will be fully explained by referring to the attached drawings. FIGS. 1 to 3 show the elevator apparatus, according to an embodiment of the present invention, and in particular, FIG. 1 shows the block diagram, FIG. 2 the upper cross-section view, and FIG. 3 the side cross-section view thereof. In FIG. 1, two (2) sets of elevators 50 and 52 are provided juxtaposing with each other within an elevating passage not shown in the figure. The two (2) elevators are almost same in the structure thereof, and therefore explanation will be made only on an elevator A50.

The elevator A 50 has an elevator car la, and on an upper surface of the elevator car 1*a* is attached a pulley 7*a* on elevator car side. On this pulley 7*a*, a rope 5*a* is suspended around, which is fixed at one end thereof onto a fixing portion 6*a* of elevator car side. After being suspended around the elevator car side pulley 7*a*, the rope 5*a* is then suspended around a sheave 8*a* equipped with a hoist 51, which is fixedly mounted within a machine room 55, being provided in the vicinity of a top portion of an elevating passage 54. And after the sheave 8*a*, it is changed in the direction thereof by means of a bending wheel 9*a*, to be suspended round a counter weight side pulley 10*a*, which is fixed in an upper portion of a counter weight 2*a*, and thereafter the rope 5*a* is fixed onto a counter weight side rope-end fixing portion 11*a* at the other end thereof. Herein, the hoist 51 has a motor 3*a*, a brake 4*a* attached onto a shaft end of the motor 3*a*, the sheave 8*a*, which is attached on the motor shaft at the opposite side of the brake 4*a*, and the bending wheel 9*a*. However, the bending wheel 9*a* may be unnecessary, depending on the position of the sheave. Also, a protection fence 12 is provided below the motor 3*a*.

Also, the structure of the elevator B52 is almost same to that mentioned above. With the elevator apparatus 50 and 52 constructed in this manner, the ropes 5*a* and 5*b* moves when the motors 3*a* and 3*b* of the hoists 51 and 53 are driven, and accompanying with this, the elevator cars 1*a* and 1*b* and the counter weights 2*a* and 2*b* moves up and down. When accommodating two (2) sets of the elevator devices within one (1) piece of the elevating passage 54 in this manner, it is necessary to use a space of the elevating passage 54 practically. Then, according to the present embodiment, a portion of the hoist 51 of the elevator A 50 and a portion of the hoist 53 of the elevator B 52 are made to protrude above the other elevator cars 1*b* and 1*a*, respectively. Further, the hoist 52 is positioned above the hoist 51. Further, the volumes of the motors 3*a* and 3*b* of the hoists 51 and 53 and the brakes 4*a* and 4*b* increase in accordance with high-lifting and high-speeding of the elevator 50 and 52. An amount of the protrusion of the hoist also increases.

The upper cross-section view is shown in FIG. 2, in particular, of the elevator apparatus shown in FIG. 1. A portion of a perpendicular projection of the motor 3*a* lies on the perpendicular projection of the elevator car 1*a*. Also, a portion of the perpendicular projection of the motor 3*b* lies on the perpendicular projection of the elevator car 1*b*. A portion of the perpendicular projection of the brake 4*a* lies on the perpendicular projection of the elevator car 1*b*, and a portion of the perpendicular projection of the brake 4*b* lies on the perpendicular projection of the elevator car 1*a*. A portion of the perpendicular projection of the motor 3*a* lies on the perpendicular projection of the motor 3*b* and the brake 4*b*. A portion of the perpendicular projection of the motor 3*b* lies on the perpendicular projection of the motor 3*a* and the brake 4*a*.

The counter weight 2*a* is guided by means of a pair of counter weight rails 15*a*, which are disposed in parallel with each other, thereby to freely move but only in the vertical direction. In the similar manner, the counter weight 2*b* is guided by means of a pair of counterweight rails 15*b* disposed in parallel with. The elevator car 1*a* is guided by means of a car rail 14*a*, which is disposed at a diagonal portion on an outer peripheral portion of the elevator car 1*a*, thereby to freely move only in the vertical direction.

Similarly, the elevator car 1*b* is guided by means of a car rail 14*b*. The reason why the car rails 14*a* and 14*b* are disposed at the diagonal position lies in that supporting rigidity thereof can be risen up when the car rails 14*a* and 14*b* support the wall 13, and thereby to bring the car rails 14*a* and 14*b* near to the wall 13 of the elevating passage. Conventionally, a supporting beam is provided in a gap defined between the cars for supporting the rails provided between the juxtaposing cars, when a plural number of elevator cars are disposed juxtaposing with each other, however according to the present embodiment, the supporting beam is not necessary.

A left-hand side cross-section view is shown in FIG. 3, in particular, of the elevator apparatus shown in FIG. 1. From this side view, it is clear that the motor 3*a* and the motor 3*b* are disposed at the positions, so that they overlap with each other vertically. Both of those motors 3*a* and 3*b* are positioned above the car la. The hoists 51 and 53 are supported by supporting beams 18, which are attached in the front surface and the rear surface of the wall 13 of the elevating passage 54. According to the present embodiment, a space being defined upper than the supporting beams 18 is used in a form of a machine room 55. Further, in FIG. 3, a control panel 19 for controlling the motors 3*a* and 3*b* is provided within the machine room 55, which is provided above the elevating passage 54.

The control panel 19, the motors 3*a* and 3*b*, the brakes 4*a* and 4*b*, and the sheaves 8*a* and 8*b* must be conducted with maintenance periodically. During the maintenance operation, since the cars being subjected under the maintenance operation move sometimes, erroneously, therefore it is often to conduct the operation from an upper portion of the juxtaposing elevator cars. In this case, there maybe a possibility that a worker falls down into the elevating passage accidentally if the worker thrusts out his body from the juxtaposing car. Then, according to the present embodiment, at the top of the elevating passage 54 is provided the protection fence 12 for dividing the space of elevating passage 54, thereby protecting the worker from falling down therein.

According to the present embodiment, it is possible to install the hoists, each having a relatively large volume, within the elevating passage or the machine room located in an upper portion of the elevating passage. When disposing the two (2) sets of hoists for the juxtaposing elevators piling up each other, much space is needed for installing the hoists in the vertical direction. However, since in a building in which the high-lift elevators are installed, mostly there are still enough room in the space, in particular in the vertical direction, therefore the present embodiment can be applied easily. However, if a requirement is made on shortening the size of the machine room in the vertical direction, it can be deal with, for example, by designing the motors 3*a* and 3*b* and the brakes 4*a* and 4*b* to be long in the size and small in the diameter thereof.

Figure 4:
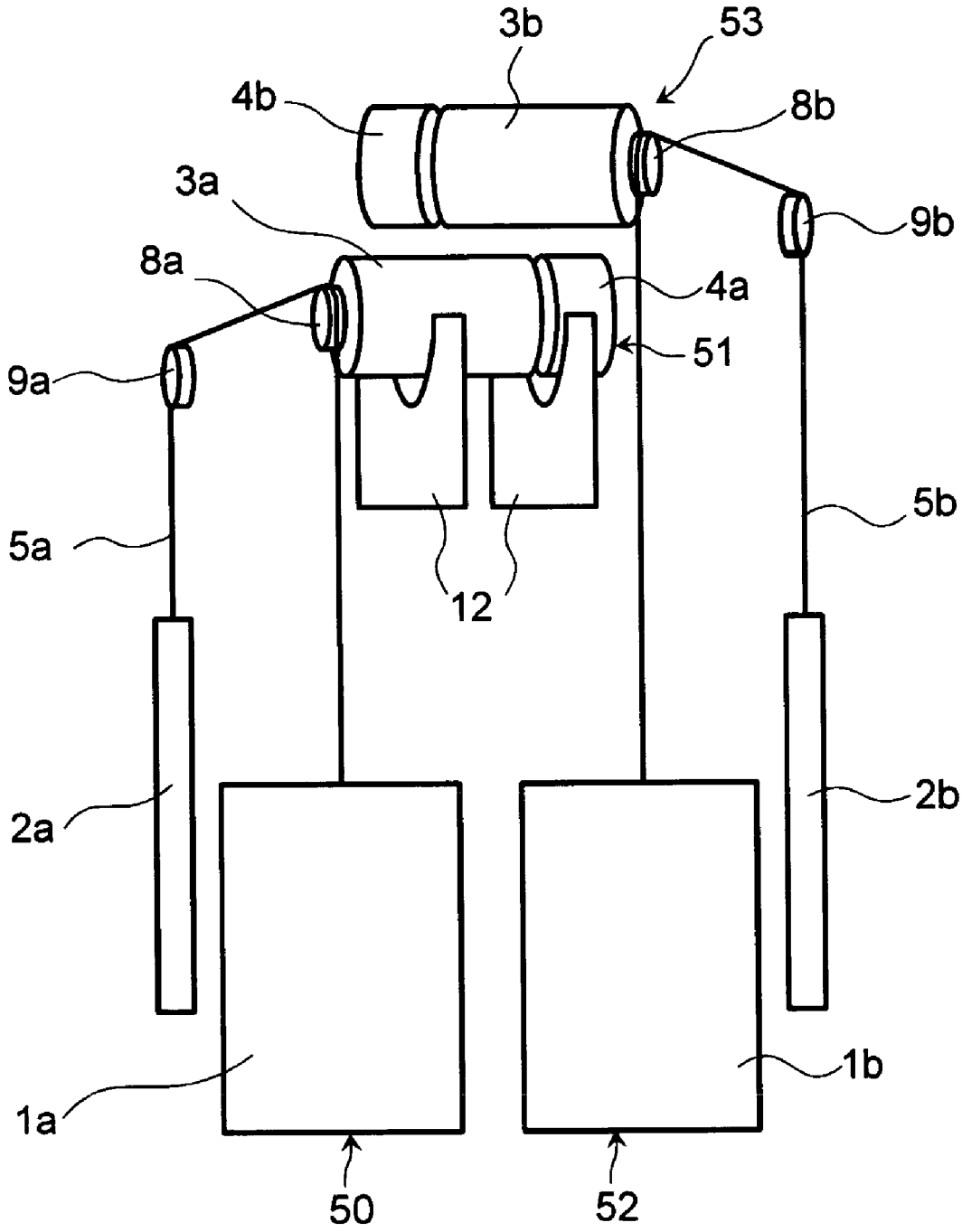
FIG. 4 is a block diagram of the elevator apparatus, according to other embodiment of the present invention.

A diagram is shown in FIG. 4, of other embodiment according to the present invention. The present embodiment differs from the embodiment mentioned above, in particular, in an aspect of omitting the pulleys of the elevator car side and the counterweight side. Since those two (2) kinds of pulleys are omitted, the one end of the ropes 5*a* or 5*b* are fixed directly onto the elevator cars 1*a* and 1*b*, while the other ends thereof are fixed to the counter weights 2*a* or 2*b*. According to the present embodiment, the equipments can be simplified. However, comparing to the embodiment shown in FIG. 1, the rotation speed required to the motors 3*a* or 3*b* comes down to be a half (½), but the torque generated by the motor 3*a* or 3*b* rises up two (2) times larger. Accordingly, large-diameter motors are necessary for the motors 3*a* and 3*b*, which can produce large torque therefrom. The present embodiment is preferable, in particular, in the case where there is enough room in the space for installing the hoists therein and there is strong necessity of simplifying the structures of the equipments thereof.

Figure 5:
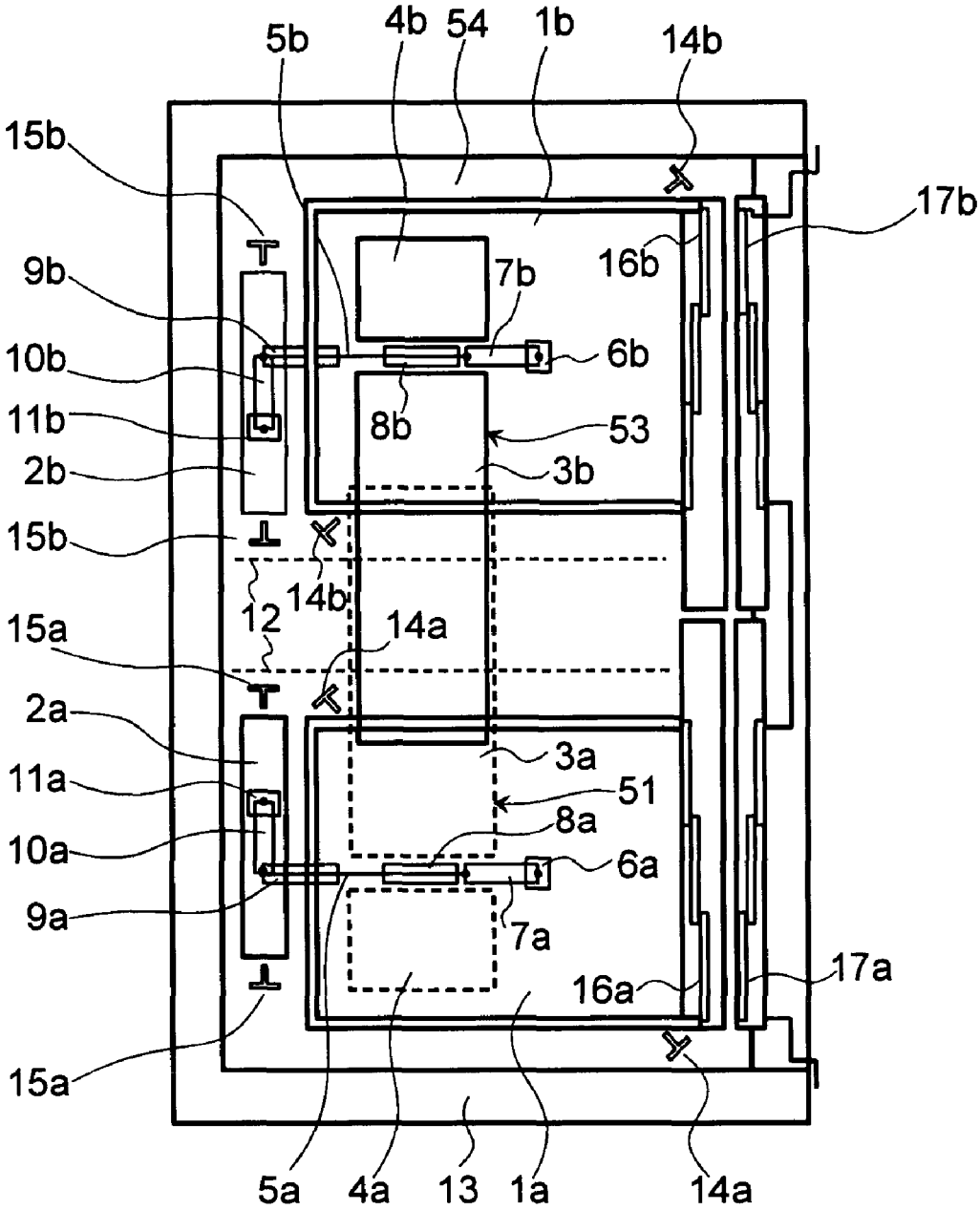
FIGS. 5 to 11 are upper cross-section views of the elevator apparatus, according to various embodiment of the present invention.
Figure 6:
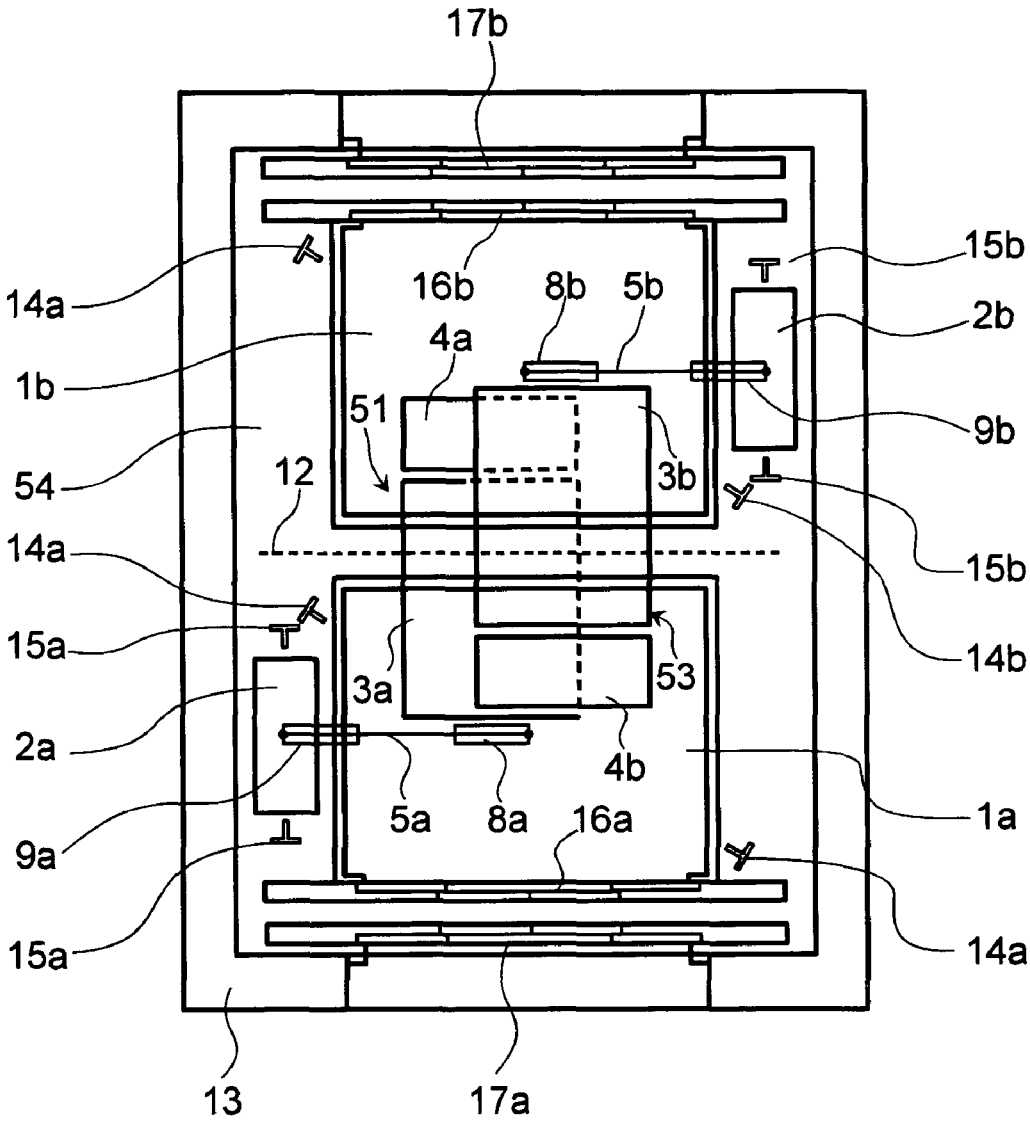
Figure 7:
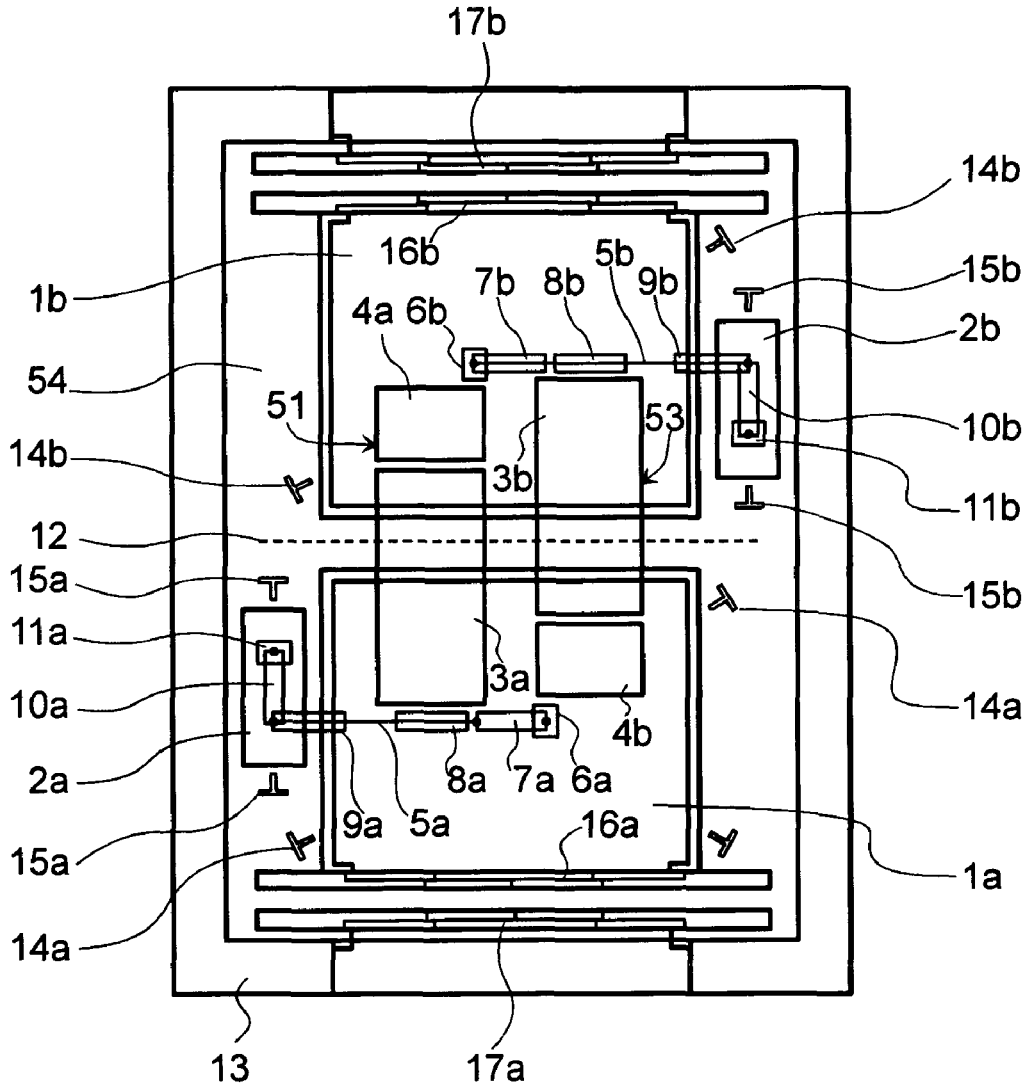

Further several embodiments according to the present invention will be shown in FIGS. 5 to 7. Any one of those figures is an upper cross-section view. The difference of the embodiment shown in FIG. 7 from that shown in FIG. 2 lies in that relative positions of the hoists 51 and 53 are changed. The brake 4*a* of the hoist 51 for the elevator A is disposed above the elevator car la, and a tail portion of the motor 3*a* is protruded until it reaches to the position above the elevator car 1*b* of the elevator B, while putting the space occupied by the elevator car side pulley 7*a* and the rope 5*b* therebetween. In the similar manner, a tail portion of the motor 3*b* of the elevator B is protruded until it comes up to the position above the elevator car 1*a*.

Namely, it is so done that the perpendicular projections of the brakes 4*a* and 4*b* lies on the perpendicular projections of their own elevator cars 1*a* and 1*b*, respectively. On a while, the perpendicular projections of the motors 3*a* and 3*b*, differing from those shown in FIG. 2, overlap with each other in a portion thereof, and with the hoists 51 and 53, the perpendicular projections thereof overlap with each other, partially. According to the present embodiment, since the distances between the sheaves 8*a* and 8*b* and the brakes 4*a* and 4*b* are made short, the torsion deformation can be made small on a shaft connecting between the sheave and the brake, thereby reducing a shock occurring when actuating the brake.

In the embodiment shown in FIG. 6, differing from the embodiment shown in FIG. 2, the elevator A and the elevator B are provided back to back. An elevator car door 16*a* and a hall door 17*a* of the elevator A, and an elevator car door 16*b* and a hall door 17*b* of the elevator B are provided on the opposite wall surfaces of the elevating passage 54. Since the elevator cars 1*a* and 1*b* are provided back to back, the counterweights 2*a* and 2*b* are disposed on the side surface of the elevator cars 1*a* and 1*b* of the respective elevators. Also, omitting the elevator car side pulley and the pulley of the counterweight, one end of the rope 5*a* or 5*b* is fixed directly to the elevator car 1*a* or 1*b*, while the other end thereof to the counterweight 2*a* or 2*b*, respectively. Further, the perpendicular projections of the hoists 51 and 53 are shifted with each other, in the horizontal direction.

According to the present embodiment, it is possible to make two (2) elevators received within one (1) elevating passage, even in such a layout of a building where two (2) sets of elevators cannot be positioned therein. Since the hoists 51 and 53 are changed in the position, in particular, the perpendicular projection thereof, then it is possible to reduce the space where the hoists are installed.

With the embodiment shown in FIG. 7, being similar to that shown in FIG. 6, two (2) sets of the elevators are positioned back to back. However, differing from the embodiment shown in FIG. 6, the perpendicular projections of the hoists 51 and 53 are shifted with each other, completely. Further, each elevator has an elevator car side pulley 7*a* or 7*b*, and a counterweight side pulley 10*a* or 10*b*. Since the installing position of the hoist 51 or 53 is shifted to the left-hand side or the right-hand side from a center of the elevator car 1*a* or 1*b*, therefore the perpendicular projections of the motors 3*a* and 3*b* and the brakes 4*a* and 4*b* will not overlap with each other. However, in FIG. 7, both the hoists 51 and 53 are positioned at the same place in the vertical direction thereof.

According to the present embodiment, it is possible to reduce the space for installing the hoists therein. Also, since it is possible to accommodate the both motors 3*a* and 3*b* within the same machine room, the hoists can be mounted at a top portion of the elevating passage, even if they are relatively large. With this, it is possible to improve utilizing efficiency of the space, in particular, in an upper layer portion of a building. Also, mounting the hoists on the same base enables installation of the hoists with cheap and easy structure. Further, it is also possible to conduct the maintenance work for the hoists from the position on the elevator cars juxtaposing with each other, with safety, and thereby shortening the time for maintenance thereof.

Figure 8:
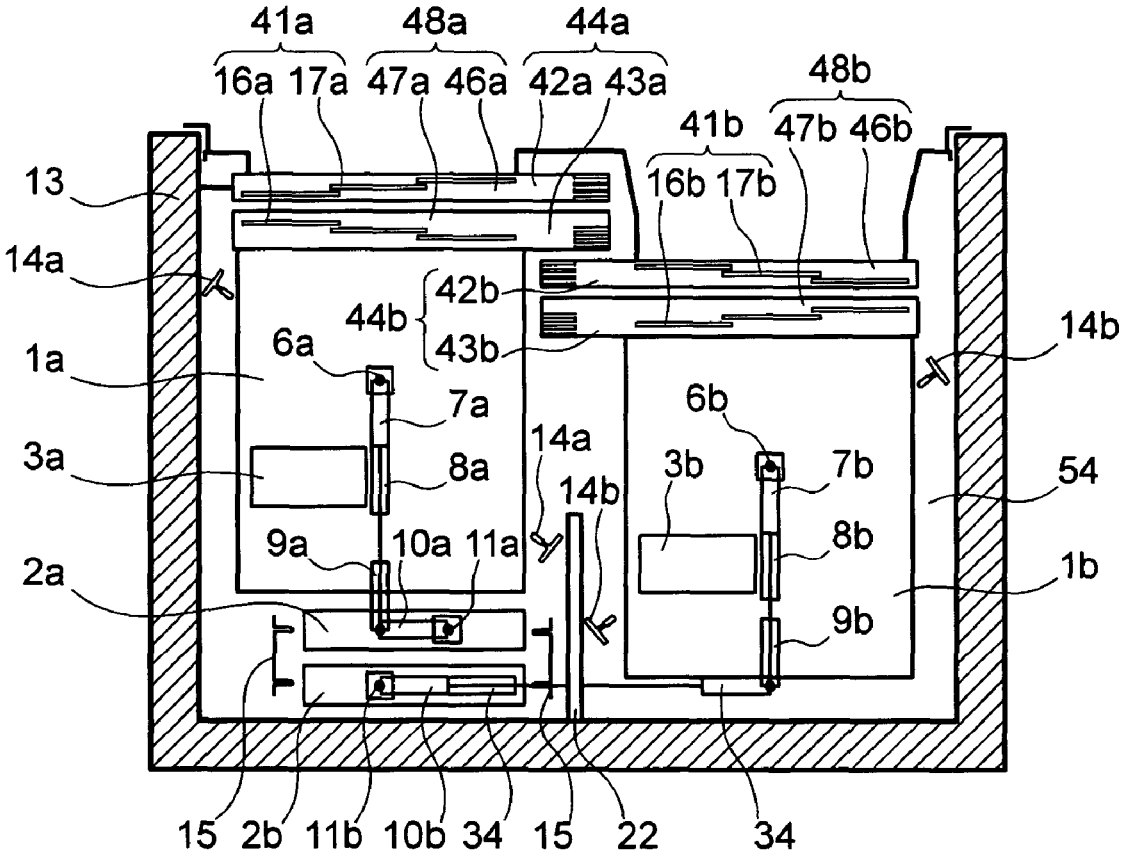

Other embodiment according to the present invention will be shown in FIG. 8 and thereafter. The elevator A and elevator B are accommodated within the elevating passage 54, which is surrounded by the elevating passage walls 13. In the instance, the elevator car 1*a* of the elevator A and the elevator car 1*b* of the elevator B are changed in the positions thereof a little bit, in the direction of front and behind. Since the two (2) sets of elevator cars 1*a* and 1*b* are received within the elevating passage 54, door cases 44*a* and 44*b* are disposed in front and behind with each other, for receiving the doors 41*a* and 41*b* therein, which open and close in the horizontal direction on the paper surface of FIG. 8, thereby effectively achieving practical utilization of an area, in particular, in front of the elevating passage 54. If bringing the length to be same between the elevator A and the elevator B in the direction of front and behind, though it is possible to keep a space in the rear surface of the elevator car 1*a* of the elevator A, the car of which locates at the front side thereof, however it is impossible to keep a sufficient space on the rear surface side of the elevator car 1*b* of the elevator B for disposing other parts thereof. Then, also the counterweight 2*b* of the elevator B is guided to the rear surface side of the elevator car 1*a*.

Further, for the purpose of elevating the elevator car 1*b*, turning pulleys 34 are disposed in a plural number of pieces thereof within a moving passage of the rope 5*b*. At the lower end of the rope suspended on those pulleys, the counterweight 2*b* is attached for holding the pulley 10*b*. The counterweight 5*b* is disposed on the rear surface of the counter weight 5*a*.

With such the present embodiment constructed in this manner, since the turning pulleys 34 are provided, the elevating passage 54 is increased in the size in the direction of height thereof. However, in such a high-rising buildings where there is a big demands for the elevators, since there is room in the size of the direction of height, such the aspect mentioned above can be escaped from. Further, the motors 3*a* and 3*b* and the turning pulleys 34 may be disposed in the direction, being oblique or perpendicular, depending on the shape and/or the cross-section area of the elevating passage 54.

Next, explanation will be given on a door portion. If aligning the door cases 44*a* and 44*b*, being necessary for receiving the doors 41*a* and 41*b* of the elevators A and B therein, on the same straight line, an effective space is reduced in the horizontal directions of the elevator. Then, according to the present embodiment, the doors on both sides are shifted in front and behind each other. Namely, the doors 41*a* and 41*b* are so disposed, that the door case 44*a* of the elevator A comes on the front surface of the door case 4*b* of the elevator B, at about the central portion of the front surface side of the elevating passage 54. The door 41*a* of the elevator A opens from the left-hand side end to the center, while the door 41*b* of the elevator B opens from the right-hand side end to the center.

For the purpose of shortening the distance in setting of the juxtaposing elevator cars 1*a* and 1*b*, guide grooves are avoided from interfering with each other, which are positioned at a lower end or an upper end of the door cases 44*a* and 44*b* attached in front of the elevator cars 1*a* and 1*b*, with such the structure as was mentioned in the above. Further, in FIG. 8, both the elevators A and B have doors 41*a* and 41*b*, each having three, (3) pieces thereof. Each of the doors are duplicated; i.e., the door on the elevator car side and the door on the hall side. As a result of this, the elevator A has three (3) pieces of the doors 16*a* on the elevator car side, and three (3) pieces of the doors 17*a* on the hall side, and the guide groove 47*a* is provided on the elevator car side while the guide groove 46*a* on the hall side. Also, the door case 43*a* is disposed on the elevator car side, and the door case 42*a* on the hall side. This is also same to the elevator B.

The elevator car 1*b* is disposed behind the elevator car 1*a*, keeping a distance therebetween, at least, adding the distance between the two (2) grooves 46*b* and 47*b* to the width of the guide groove 46*b* on the elevator car side and the width of the door guide groove 47*b* on the hall side. Since the elevator car 1*b* is disposed behind the elevator car 1*a*, the door guide groove 46*b* is also positioned at the rear side by shifting a distance, at which the elevator car 1*b* is shifted. Further, the elevator car 1*b* is positioned as close to the elevating passage 13 as possible, to reduce the distance between the elevator car 1*b* and the wall 13 of elevating passage, thereby utilizing the space of the elevating passage 54, practically. For this reason, under the condition when the door groove 46*b* on the hall side is shifted behind, the door groove 46*b* is fixed on the wall 13 of elevating passage by using, such as, a member of L-like shape attached on the wall 13 of elevating passage, not shown in the figure, for example.

Since the elevator car 1*b* of the elevator B is shifted behind, there is no space remaining on the rear side of the elevator car 1*b*. However, on the rear surface of the elevator car 1*a* of the elevator A can be defined a space by shifting the elevator car 1*b* behind. Then, the counterweights 2*a* and 2*b* for the two (2) sets of the elevators are disposed in such the manner as was mentioned in the above. According to the present embodiment, since the elevators A and B are assumed to be the same, the counterweights 2*a* and 2*b* are also same to each other in the size of width thereof. Then, a pair of rails 15 on the left-hand side and the right-hand side is formed, by forming the rails for those counterweights in one body. This rail 15 can be manufactured, for example, by forming steel plate into a shape having plural steps through the roll forming, or using a press one-piece molding through drawing. According to the present embodiment, it is possible to reduce the installation time necessary for installing the rails 15, which is long in the length and is required to be installed at high accuracy.

When installing the elevators juxtaposing with each other, conventionally, support beams 22 are provided extending from the rear side to the front side of the elevating passage 54, at a predetermined distance therebetween, in the direction of height of the elevating passage of the gap, which is defined by the juxtaposing elevator cars 1*a* and 1*b*, thereby supporting the elevator car rails 14*a* and 14*b*. According to the present embodiment, due to the structure that the door cases 44*a* and 44*b* lie on each other in the direction of front and behind the elevating passage 54, it is impossible to extend the support beams 22 up to the front surface of the elevating passage 54. Then, the support beams 22 are extended from the elevating passage 54 on the rear side thereof in a cantilever-like manner. Further, the elevator car rails 14*a* and 14*b* are provided inclining to the elevator cars 1*a* and 1*b*, and they are disposed symmetrically on both sides, in the width direction of the elevating passage 54.

According to the present embodiment, since the two (2) pairs of the elevator car rails 14*a* and 14*b* are supported at the locations relatively near to the wall 13 of elevating passage, therefore it is possible to support the weight of the entire elevators, easily. Also, since the plural number of elevator car rails 14*a* and 14*b* and the counterweight rail 15 are attached by means of one (1) piece of a part not shown in the figure, it is possible to reduce the number of parts.

Though the elevator B is shifted behind in the embodiment mentioned above, however it is also possible to shift behind any one of the juxtaposing elevators. Also, since there is a possibility that a passenger is blocked in her/his view by the door 41*a* of the elevator car 1*a* of the elevator A, when she/he comes out into the hall from the elevator car 1*b* of the elevator B, which is shifted behind, it is preferable to provide a design having an inclination. Further, according to the present embodiment, it is also possible to reduce the distance for setting the juxtaposing elevator cars therein, at the most, by the length of the door case for one (1) set.

Figure 9:
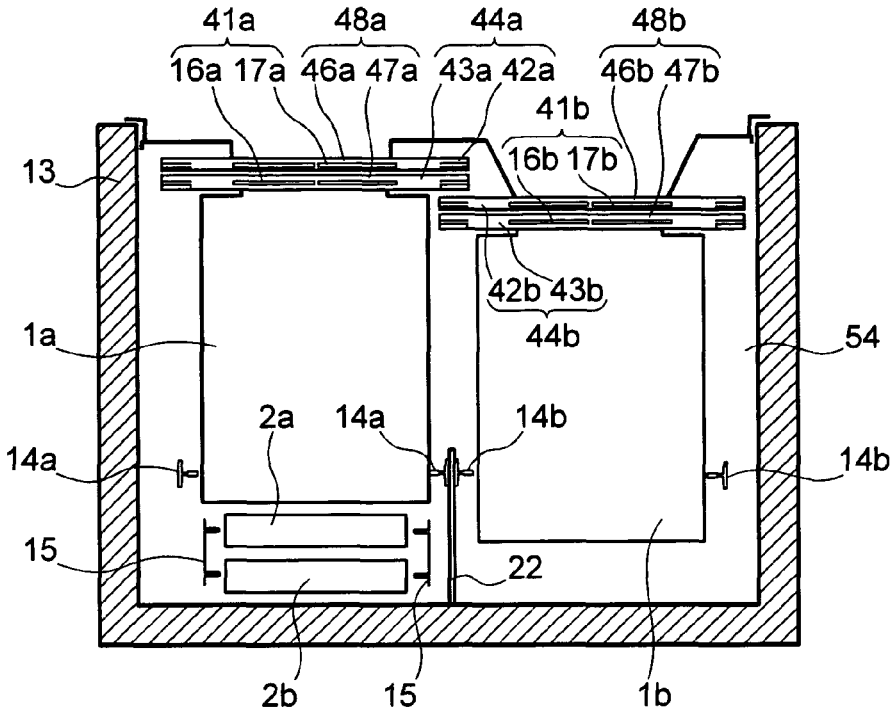

Other embodiment of the elevator apparatus according to the present invention will be shown in FIG. 9. The feature of the present embodiment, differing from that shown in FIG. 8, leis in that the doors 41*a* and 41*b* on the elevator car side and the hall side adopt doors, each of which opens directing from the center to the both sides of the each elevator in both the elevator A and the elevator B. In the similar manner to the embodiment mentioned above, the door cases 44*a* and 44*b* overlap each other in the direction of front and behind the elevating passage 54, each of which receives the right-hand side door of the elevator A or the left-hand side door of the elevator B therein. With this, it is possible to narrow the distance between the juxtaposing elevator cars 1*a* and 1*b*. According to the present embodiment, comparing to the embodiment mentioned above, it is possible to narrow the width of the door guide grooves 48*a* and 48*b*, thereby to make an amount of shifting the elevator B behind small. However, the pieces of the doors of the doors 41*a* or 41*b* is two (2) in the present embodiment, but a door having four (4) pieces of doors can be also applied to the doors 41*a* and 41*b*, in the similar manner.

Figure 10:
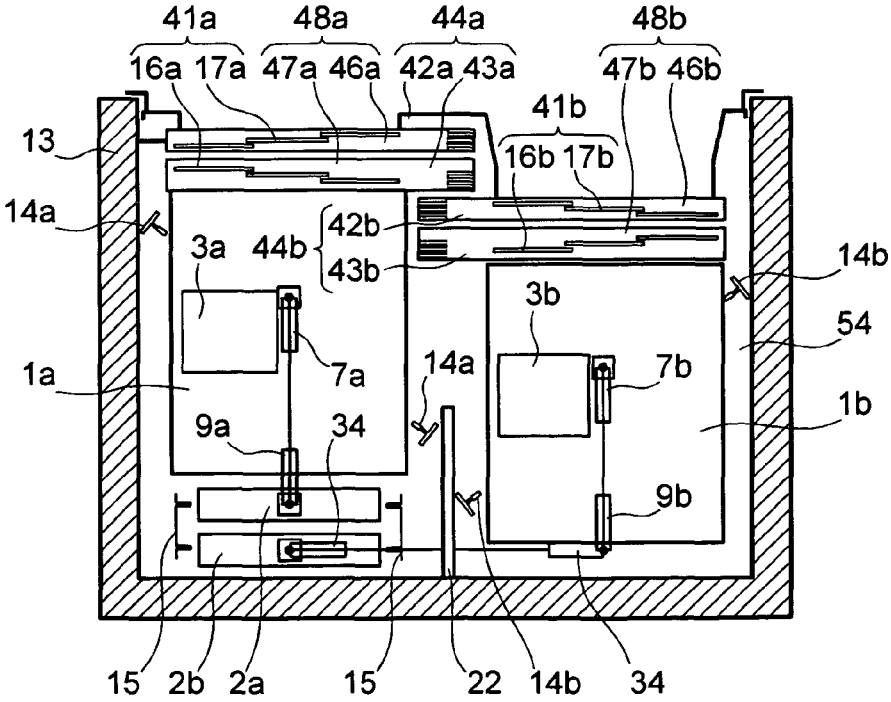

Further other embodiment of the elevator apparatus, according to the present invention, will be shown in FIG. 10. The difference of the present embodiment from that shown in FIG. 8 lies in that the pulleys are omitted, which are provided on the top surface of the elevator cars. Though not shown in the figure, also the pulleys are omitted on the counterweight side. This is preferable to a building, which has a space in the machine room, relatively, and therefore the motors 3*a* and 3*b* can be large-sized. Comparing to the embodiment shown in FIG. 8, the motors 3*a* and 3*b* increase the volume thereof, since the rotation speed comes down to a half (½) and the torque come up to two-times large (×2), but the roping structure is simple, and therefore it is possible to narrow the distance between the elevator cars 1*a* and 1*b*.

In this FIG. 10, it is also possible to provide a pulley on the counterweigh side, thereby bringing an amount of elevation of the counterweights 2*a* and 2*b* to be a half (½) of that of the elevator cars 1*a* and 1*b*. For example, the two (2) pieces of the counterweights 2*a* and 2*b* are elevated only in a lower portion below a half of the total elevating region of the elevator cars 1*a* and 1*b*. With this, a space can be defined in an upper portion of the elevating passage 54, by the width of the two (2) sets of the counterweights. If providing an electric power unit and/or a control panel not shown in the figure in this space, freedom can be increased in disposing the equipments, and it is possible to save the space for the elevator apparatus. Also, since the elevation amount come down to a half (½) on the counterweights 2*a* and 2*b*, it is sufficient to provide the counterweight rails 15 (see FIG. 10) only in the lower side half of the elevating passage 54. According to the present embodiment, with parallel provision of the counterweights 2*a* and 2*b* in front and behind, the rails can be formed in one body or can be reduced down to a half (½) in the length thereof, therefore it is possible to shorten the time necessary for installing the rails, greatly.

Figure 11:
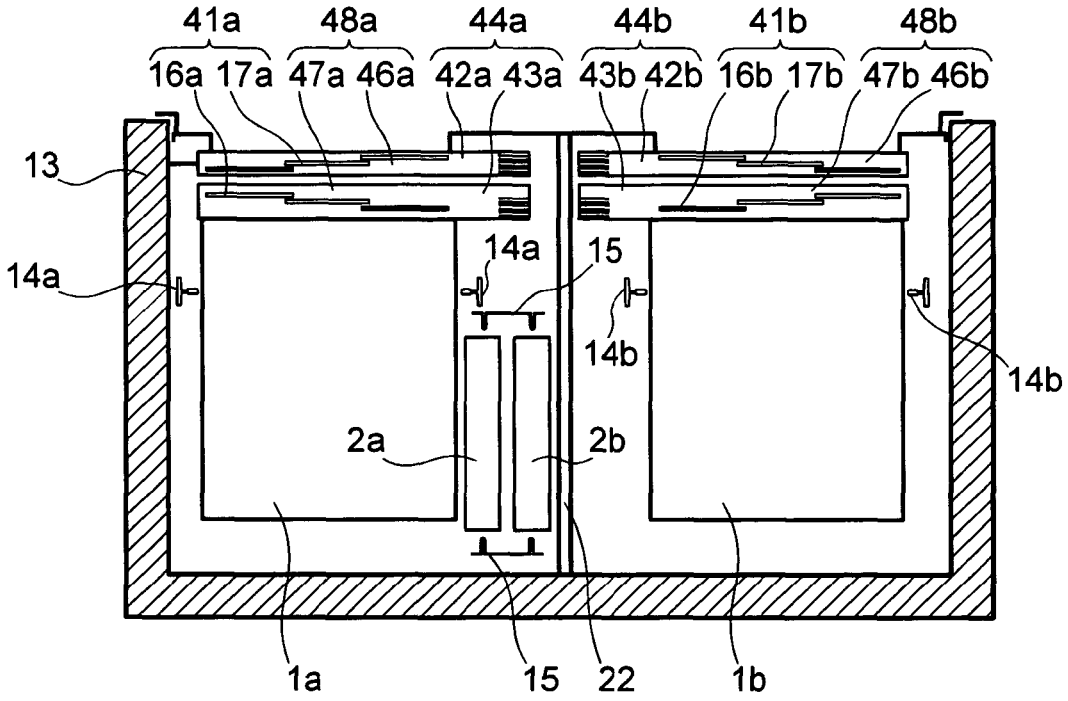

Further other embodiment of the elevator apparatus will be shown in FIG. 11, according to the present invention. The feature of the present embodiment, differing from that shown in FIG. 10 mentioned above, lies in that the elevator A and the elevator B are positioned to be almost same to each other on at the front surfaces thereof, and the counterweights are disposed between the two (2) sets of the elevators. Since the elevator A and the elevator B are same at the front surface position, the elevator cars 1*a* and 1*b* are positioned lying up to the vicinity of the wall surface on the rear side of the elevating passage 54. Without shifting the positions of the elevator cars 1*a* and 1*b* in front and behind, it is possible to dispose the plural number of the counterweights 2*a* and 2*b* in one (1) place, thereby enabling to form the rails for the two (2) sets into a pair of rails 15, in one body.

Figure 12:
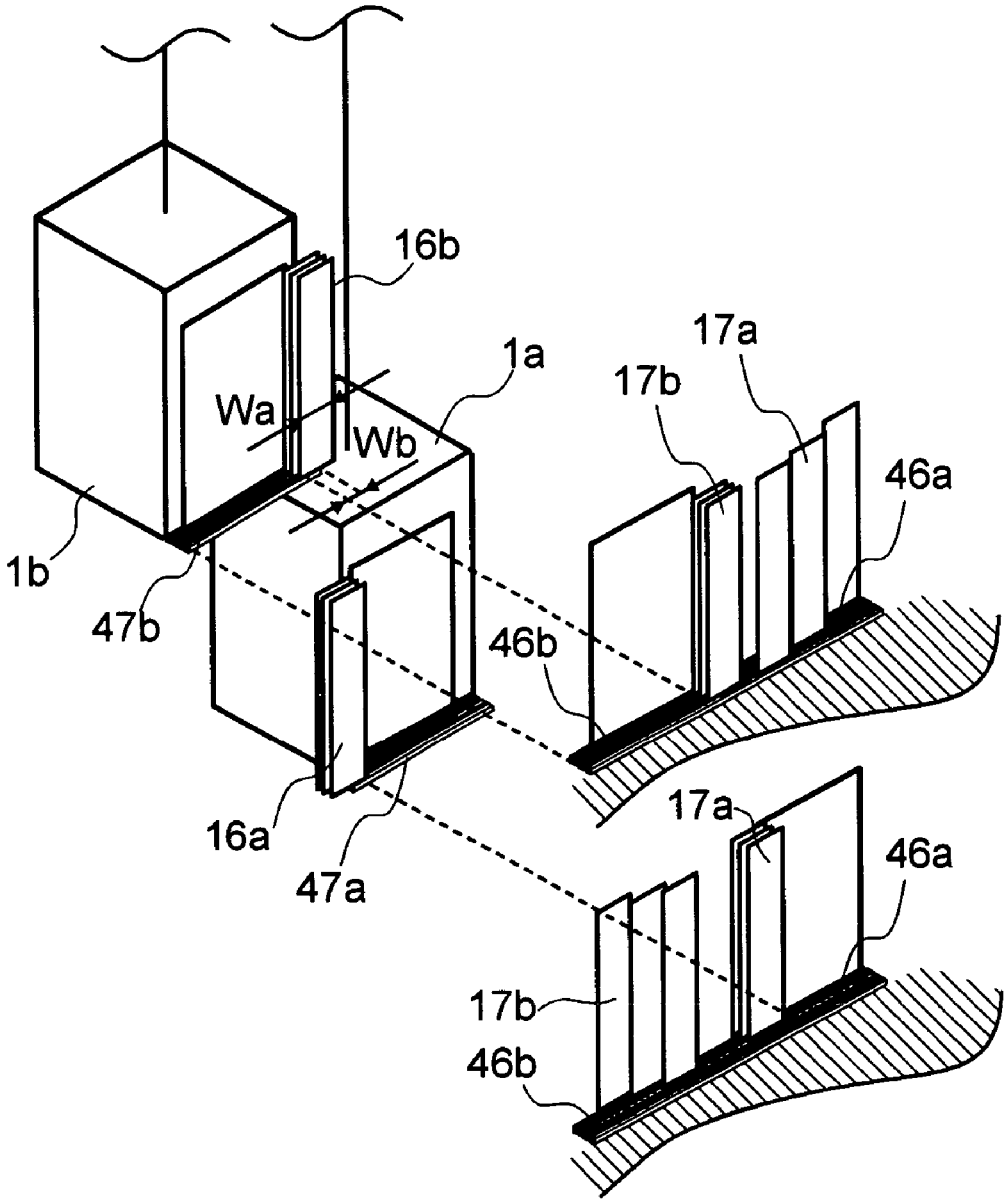
FIG. 12 is a view for explaining a door portion of an elevator, which was shown in FIG. 2.

Further other embodiment of the elevator apparatus will be shown, by referring to FIG. 2 and FIG. 12, according to the present invention. FIG. 12 is a perspective view for explaining opening and closing of the doors. In the similar manner to that shown in FIG. 11, the elevator A and the elevator B are same at the front surface position thereof. However, differing from that shown in FIG. 11, the door cases 43*a* and 43*b* of the doors 41*a* and 41*b*, in the present embodiment, are made short in the distance therebetween, and they are built up, so that when one of the juxtaposing elevators is opening the door thereof, the other elevator car will not be on the same floor; i.e., the door of the other elevator will not open. And, when the door of the elevator A opens, the door case 43*a* on the elevator car side holds the door 16*a* at the portion thereof, thereby projecting the remaining portion of the door into the space of the elevating passage in a cantilever-like manner. In this instance, though also the door 17*a* on the hall side tries to open at the same time, however the door 17*a* is held under the condition that it projects a portion thereof into the guide groove on the side of the elevator B. It is also similar when the elevator B opens the door 42*b*.

FIG. 12 shows the details thereof. Herein, it is assumed that the width of the doors 41*a* and 41*b* is "Wa". And, the length "Wb" of the door cases 43*a* and 43*b* is made to be shorter than the door width "Wa". Thus, the doors 41*a* or 41*b* protrude into a side of the other elevator by the difference between the door width "Wa" and the door case length "Wb". With this, it is possible to make the distance "L"short between the two (2) sets of the elevator cars. However, a sum of the lengths "Wb "s of the respective door cases 43*a* and 43*b* is necessary to be larger than the width "Wa" of the door 41*a* or 41*b*, and the distance "L" between the elevator cars must be longer than the sum of the lengths "Wb"s of the respective door cases 43*a* and 43*b*. However, in the present embodiment, when the doors 41*a* and 41*b* come up or down to the same floor, thereby trying to open the doors 41*a* and 41*b*, the doors 41*a* and 41*b* interfere with each other. Then, operation is so controlled that the juxtaposing elevator cars stop at the different floors always.

According to the present embodiment, since the doors 17*a* and 17*b* on the hall side of the juxtaposing elevators are guided by means of one (1) piece of the door guidance groove 46, the guidance grooves 42*a* and 42*b* (see FIG. 11) can be formed into a part of one body, therefore it is possible to shorten an installation time for the door guidance groove 46. Further, when two (2) sets of the elevator cars stop at the same floor at the same time, after completion of opening-closing operation of the door on the one elevator car 1*a*, the opening-closing operation is started on the other elevator car 1*b*. Or, alternately, they are avoided from interfering with each other, by interconnecting the time for initiating the opening operation of the door 41*a* on the one elevator car 1*a* and the time for initiating the closing operation of the door 41*b* on the other elevator car 1*b*, so that they can operate at the same timing. However, in each of those embodiments mentioned above, it is also possible to be applied into a case where the elevators are installed in the number of three (3) or more than that.

The elevator apparatus, according to each of the embodiments mentioned above, is also effective when it is retrofitted into the existing elevating passage. It is possible to maximize the area of the elevator cars, in particular, when two (2) elevator cars, each being for four (4) passengers, are installed within the same elevating passage, in the place of the existing elevator car for a large number of passengers, for example.

As was mentioned in the above, according to the present invention, since the hoist of at least one of the juxtaposing elevators is protruded above the other elevator car, it is possible to reduce an area necessary for the elevating passage. Also, since the dispositions of a plural number of elevators, which are installed juxtaposing with each other, are shifted in the direction of front and behind, or since the position of the door for opening/closing is projected into the side of the other elevator when opening, it is possible to reduce the size of width of the elevating passage. Further, it is also possible to reduce the area necessary for installing the elevators therein.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. An elevator apparatus, comprising:

a plural number of elevators being juxtaposed with each other, each said elevator having an elevator car, a hoist, a rope, a counterweight and a hall side door guidance groove for letting the opening/closing door of the one elevator project into a side of the other elevator when the open/close door is opened, wherein portion of the hoist of one of said elevators overlaps a vertical projection of the elevator car of the other elevator.

2. An elevator apparatus, providing a plural number of elevators juxtaposed with each other within an elevator passage, wherein positions of an open/close door portion of one of the elevators and an open/close door portion of the other of the elevators are shifted with the one in front of the other, wherein guide rails are disposed on a rear surface of the elevator passage, having the open-close door portion in front, for allowing counterweights of the plural number of elevators to elevate.

3. An elevator apparatus, as described in the claim 2, wherein a pulley is provided on each of said counterweights, on which pulley a rope for allowing the counterweight to elevate is suspended, and a controller is provided in an upper portion of the elevating passage, in which the counterweight elevates.

4. An elevator apparatus, having a plural number of elevators provided juxtaposing with each other within an elevator passage, each elevator having an elevator car and a hoist, which is connected to the elevator car through a rope, wherein the hoist of one elevator projects above the elevator car of the other elevator, and comprising a hall side door guidance groove for allowing an open/close door of the one elevator to project to a side of the other elevator when said open/close door opens.

5. An elevator apparatus, as described in the claim 4, wherein rails are provided in a space defined between the plural numbers of elevator cars, on which the counterweights of the plural number of the elevators elevate.

6. An elevator apparatus, as described in the claim 4, wherein a guidance length of a door case for receiving said open/close door therein of the elevator car side is shorter than a door width of said open/close door.

7. An elevator apparatus, as described in the claim 4, wherein said hail side door guidance groove can be used in common with the juxtaposing elevators.

8. An elevator apparatus, as described in the claim 4, further comprising a controller means for controlling, so that when stopping one of two (2) sets of elevators juxtaposing with each other among said plural numbers of elevators, the other elevator stops a floor different therefrom.

9. An elevator apparatus, as described in the claim 4, further comprising a controller means for controlling, so that when stopping two (2) sets of juxtaposing elevators among said plural numbers of elevators at a same floor, while an open/close door of the one elevator opens, an open/close door of the other elevator is kept to close.

* * * * *